United States Patent [19]

Kim

[11] Patent Number: 4,688,344

[45] Date of Patent: Aug. 25, 1987

[54] CARTRIDGE CLIP INSERTION TYPED MAGAZINE FOR USE IN THE MAGAZINE TYPE AUTOMATIC SMALL WEAPON

[76] Inventor: Kwang M. Kim, 61-1, Neung-dong, Songdong-ku, Seoul, Rep. of Korea

[21] Appl. No.: 878,785

[22] Filed: Jun. 26, 1986

[30] Foreign Application Priority Data

Feb. 15, 1986 [KR] Rep. of Korea ..... 86-1067

[51] Int. Cl.[4] ..... F41C 25/02; F42B 39/06

[52] U.S. Cl. ..... 42/50; 42/88

[58] Field of Search ..... 42/50, 7, 87, 88, 18

[56] References Cited

U.S. PATENT DOCUMENTS 1,119,756 12/1914 Howe ..... 42/7

2,910,795 11/1959 Agren ..... 42/50

3,736,686 6/1973 Moller et al. ..... 42/50

4,226,041 10/1980 Goodworth ..... 42/50

4,430,821 2/1984 Vincent ..... 42/50

*Primary Examiner*—Charles T. Jordan

*Attorney, Agent, or Firm*—Birch, Stewart, Kolasch & Birch

[57] ABSTRACT

An ammunition containing device for loading into an automatic firing weapon which comprises, in combination, a magazine adapted to receive a cartridge clip which contains a plurality of rounds of ammunition, the magazine comprising a housing containing an inlet aperture, a spring disposed in the bottom of the magazine, a cartridge follower slidably disposed within the magazine adjacent the spring, a depressed cartridge follower disposed within the magazine against the bias of the spring, and a cartridge clip containing ammunition adapted to be inserted through the inlet aperture into the magazine, above the depressed cartridge follower.

6 Claims, 13 Drawing Figures

CARTRIDGE CLIP INSERTION TYPED MAGAZINE FOR USE IN THE MAGAZINE TYPE AUTOMATIC SMALL WEAPON

FIELD OF THE INVENTION

The present invention relates to a cartridge clip insertion type magazine in a magazine type automatic small weapon wherein the magazine can be loaded with from twenty to thirty rounds of ammunition at one time with only on action of insertion of the cartridge.

BACKGROUND OF THE INVENTION

The conventional method of utilizing a magazine for loading cartridges is that a shooter should load the cartridges into the magazine one by one and insert the magazine including the cartridges into the weapon. Since there is the annoying problem of the necessity to reload the cartridge, one by one, into an empty magazine which is taken away from a rifle after the ammunition in the magazine is consumed, the firing power is weakened due to the time delay needed to reload the cartridges into the magazine, particularly in the case of an emergency when a combat soldier has to fire for long time periods against a surprise attack by a large enemy force.

At the time of the Vietnam conflict where the Korean Army participated, a combat soldier had to meet combat conditions carrying seven or eight loaded magazines as well as paper boxes packed with twenty round cartridges.

Thus, when the ammunition of the seven to eight magazines were consumed, the paper box units of twenty rounds had to be reloaded into empty magazines, one by one, while hiding in a prostrate position. In the case of the automatic M-16 rifle, a magazine loaded with twenty rounds of ammunition is fired in no more than a few minutes. Accordingly, it can be easily determined how fast the ammunition is consumed when automatically firing the magazines of the seven or eight pieces. Furthermore, a period of time required to reload a magazine with the twenty rounds of cartridges is about thirty seconds for a skilled shooter to as high as two to three minutes according to the particular situation. It can be concluded that the time for reloading the ammunition is more than several times the firing time.

By reason of these defects experienced during combat, the soldiers' reloading operation had to be executed under the covering fire of automatic small weapons or during the covering fire of comrades in arms. However, in the case of an all out assault, a special commando mission, an attack by a large enemy troop, a reconnaissance mission with a small unit or in other extreme situations, the sacrifice of life due to the time required for reloading was severe.

Further, to shorten the period of time for reloading the cartridge and to make it possible to easily reload the cartridges into the magazines, filled cartridges which were filled with ten rounds of ammunition and in which rails were attached to the back of the cartridge adjacent to the percussion cap of the paper box were supplied at the time of the Vietnam war.

The railing cartridge, after setting the adaptor on the back part of the empty magazine and inserting the end of the rails therein, is depressed from the top to the bottom by the thumb and then ten rounds are loaded one after the other. However, a defect of this device is the necessity of applying force against the elasticity of the spring, and further if the ammunition is depressed with excessive force, it becomes twisted and extends away from the rails so that the loading must be halted, and at the same time, the finger might be injured by bumping into the rails and magazine due to the force of the continuous depressing action. Therefore, this device suffers from the same type of deficiencies as the other conventional devices.

Furthermore, in the case of trying to load twenty rounds of ammunition into the magazine, because of the strong urging force of the spring, it is only possible to load from seventeen to eighteen rounds into the magazine. In this case, it is very difficult to reload the cartridges because the spring in the magazine is depressed too strongly for a soldier to overcome the urging force thereof. To avoid this difficulty, the combat soldiers, in many cases, threw away the remaining two-three rounds of ammunition in the paper box during combat situations. Thus, a material loss of ammunition is the result. Also, the enemy could get and use the ammunition and weapons of our troops. Furthermore, it was impossible to reload the ammunition into the magazine with the rail type cartridges while engaging in night combat. It was also inconvenient to reload the ammunition in cold weather if one is to return to the conventional way of reloading ammunition, one by one, which results in a decrease in firing power and fighting power.

A device which can be reloaded at once into a magazine directly utilizing a cartridge clip containing from twenty to thirty rounds is suggested in U.S. Pat. No. 4,226,041. However, U.S. Pat. No. 4,226,041 has a number of deficiencies including a high developing cost because it is necessary to change the structure of the magazines and the weapons in order to apply this device, since it is impossible to use the device directly on existing weapons due to the structure of inserting the magazine directly into the weapon.

OBJECT OF THE INVENTION

It is therefore an object of the present invention to solve the various problems as described above by providing a cartridge clip and a magazine wherein cartridges containing twenty to thirty rounds of ammunition can be reloaded into magazines of existing weapons rapidly and easily without changing the structure of the magazines or the weapons.

Another object of the present invention is to make possible the reduction of expenditures by merely changing the structure of the magazine wherein the latch and an inserting inlet opening are formed in the existing weapons whereby a cartridge clip containing twenty to thirty rounds of ammunition is inserted into the magazine through an inlet opening which is formed on the rear wall of the magazine.

A further object of the present invention is to be able to reload the cartridges containing twenty to thirty rounds of preloaded ammunition into a magazine merely by reloading the cartridge clip through an insert hole in the back of the magazine. Therefore, the reloading process and period of time to reload the cartridges are markedly reduced, thereby providing more time for observing the combat situation. Therefore the purpose of the present invention is to improve the firing and fighting power by being able to meet the rapidly changing combat situation.

Still another object of the present invention is to provide a cartridge clip insertion typed magazine wherein only one or two spare magazines need be carried because numerous cartridge clips can be reloaded into the magazines. Therefore, an object of the present invention is to better arm a combat soldier.

SUMMARY OF THE INVENTION

The objects of the present invention are obtained by providing a special cartridge clip and a magazine to be inserted into an automatic small weapon. According to the present invention, a magazine is formed in the rear wall and a cartridge clip containing from twenty to thirty rounds is preloaded and held securely within the weapon.

After firing, the empty cartridge clip is removed easily by pulling it out and another cartridge clip is preloaded by inserting it through an inlet opening into the magazine. Now the weapon is ready to fire from twenty to thirty rounds of ammunition which can be repeated again and again, successively. Thus, a magazine which applies a cartridge clip according to the present invention can be used in conventional automatic small weapons of the magazine type without any mechanical modification.

BRIEF DESCRIPTION OF THE ACCOMPANYING DRAWINGS

The present invention will become more fully understood from the detailed description given hereinbelow and the accompanying drawings which are given by way of illustration only, and thus are not limitative of the present invention, and wherein.

DESCRIPTION OF THE EMBODIMENTS OF THE INVENTION

Figure 1:
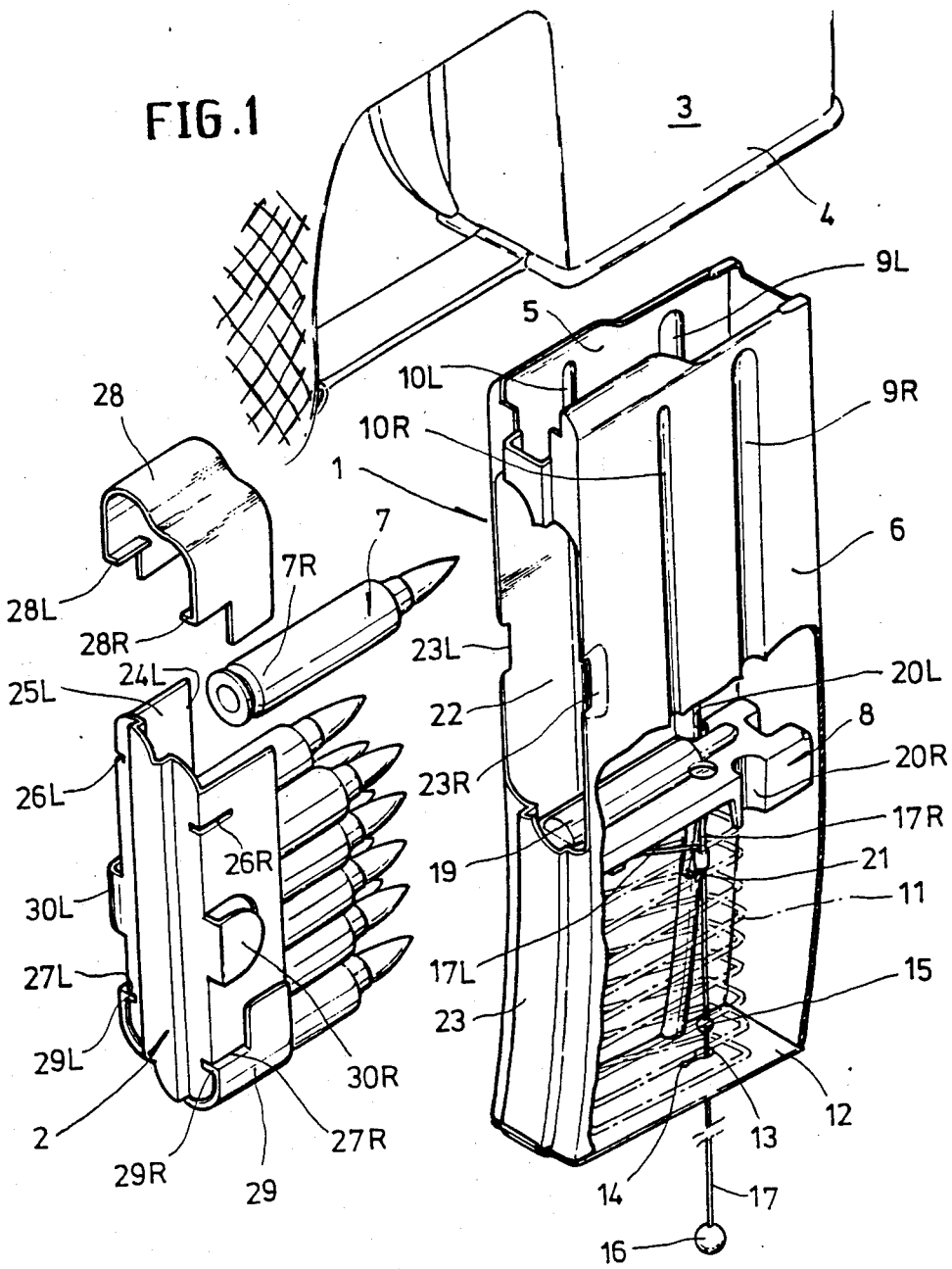
FIG. 1 is a perspective view illustrating basic components such as a cartridge clip and a magazine according to the present invention.
Figure 2:
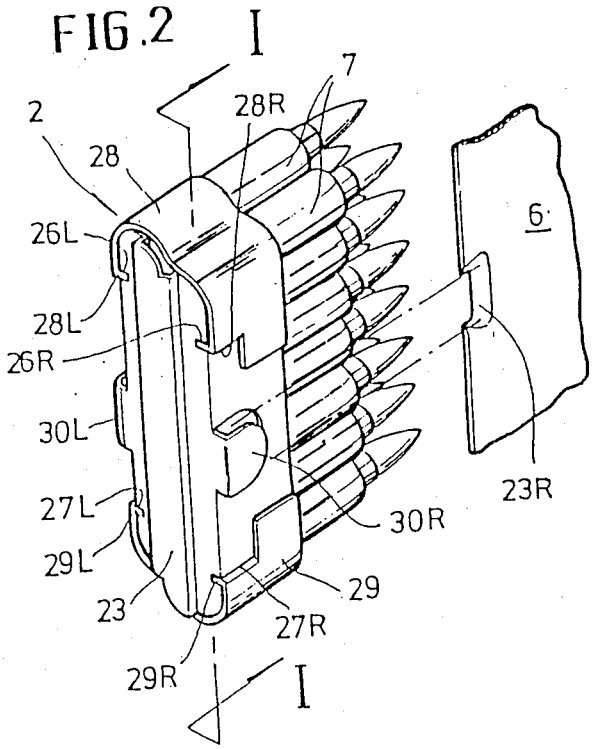
FIG. 2 is a perspective view of a cartridge clip of the present invention.
Figure 11:
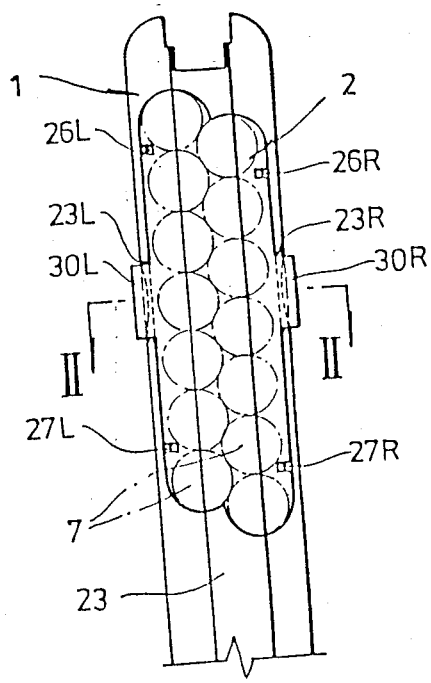
FIG 11 is an end view of a cartridge clip in a magazine according to the present invention.
Figure 3:
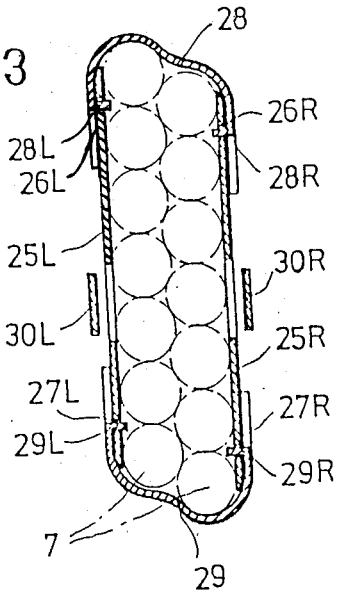
FIG. 3 is a sectional view, taken along lines I—I of FIG 2.

In FIG. 1 there are illustrated a cartridge clip 2 and a magazine 1. The cartridge clip is inserted into the magazine which, in turn, is inserted into a hole 4 of a conventional automatic weapon 3.

Inside of both side walls 5, 6 of the magazine 1 are provided a pair of large and small guide rails 9L, 9R and 10L, 10R on the respective right and left walls thereof. The guide rails extend longitudinally along the walls of the magazine and into the cavity of the magazine. A cartridge follower 8 is slidably mounted within the cavity of the magazine and is connected to a follower spring which is biased so as to urge the follower to move in the upward direction.

On the bottom 12 of the magazine 1 a guide hole 13 and a latch hole 14 are provided. A pulling cord wire 17 extends through these holes for latching and releasing the spring biased follower. The follower is restrained by a small diameter latching ball 15 which is smaller than the diameter of the guide hole 13 and a large diameter relasing ball 16 disposed at the lower end of the pulling cord wire 17. The right and left ends 17R, 17L of the upper end of the pulling cord wire are connected to the cartridge follower 8 by the washers 18R, 18L which are secured in the securing holes 8R, 8L.

Further, on the rear wall of the magazine 1 an inserting inlet opening 22 for a cartridge clip 2 to be inserted, which will be described hereafter, is formed longitudinally, in the middle on the right and left side wall of the inserting inlet opening 22. Also, right and left finger concaves 23R, 23L are provided for inserting or pulling out a cartridge clip easily to or from a magazine 1.

Therefore, in the case of inserting a cartridge clip 2 through the inserting inlet opening 22 of a magazine 1, the latching ball 15 of the pulling cord wire 17 is drawn out of guide hole 13 by pulling down the releasing ball 16 of the pulling cord wire 17 through the guide hole 13 which is formed on the bottom 12 of the magazine. If the latching ball 15 is latched up to the small diameter latching hole 14 which communicates with the guide hole 13, then a cartridge follower 8 is positioned in a fixed state beneath the inserting inlet opening 22 which is formed on the rear wall of a magazine 1. A cartridge clip 2 can now be easily inserted. Furthermore, if the latching ball 15 is released from the guide hole 13 and the latching hole 14 by pulling the cord wire 17 then the cartridge follower 8 urges the bottom of the cartridge clip 2 by the elasticity of the follower spring 12.

As illustrated in FIGS. 1, 2, 3, 11 and 12, the rear plate 23' of a cartridge clip is formed the same as the rear wall 23 of a magazine 1 and both ends 24R, 24L of the respective side wall latesp 25R, 25L are inclined slightly inwardly and have elasticity so that it forms a "C" shape, and the cartridges 7 with their rear portion 7R are held in a two row, zig-zag arrangement in the space between the right and left of the side wall plates 25R, 25L.

Further, inserting slots in the right and left sides and at the top and at the bottom, 26R, 26L, 27R and 27L are formed on both side wall plate 25R and 25L of the cartridge clip 2. The inserting pieces 28R, 28L, 29R and 29L of the fixing caps 28, 29, which prevent the releasing of the cartridges 7 in the cartridge clip 2 are inserted and fixed therein, so that the phenomena that the cartridges 7 are scattered and released from the cartridge clip when handling during transportation or carrying are prevented. Thus, the openings of the upper and lower parts of cartridge clip 2 are closed by elements 28, 29 which engage with the side wall plates 25R, 25L. On the right and left side wall plates 25R, 25L of the cartridge clip, inserting finger grip pieces 30R, 30L are provided which extend out to lock up and securely hold the cartridge clip 2 into the magazine 1 by inserting the finger grip pieces into the concaves 23R, 23L which are formed on the right and left side walls 5, 6 of the inserting inlet opening 22 of the magazine.

Figure 8A:
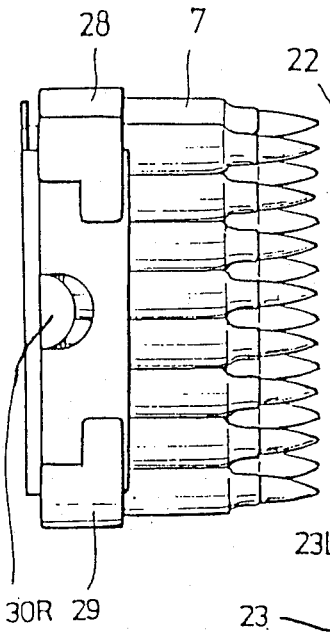
FIG. 8A is a side view showing the order of loading cartridges into a cartridge clip in accordance with the present invention.
Figure 8B:
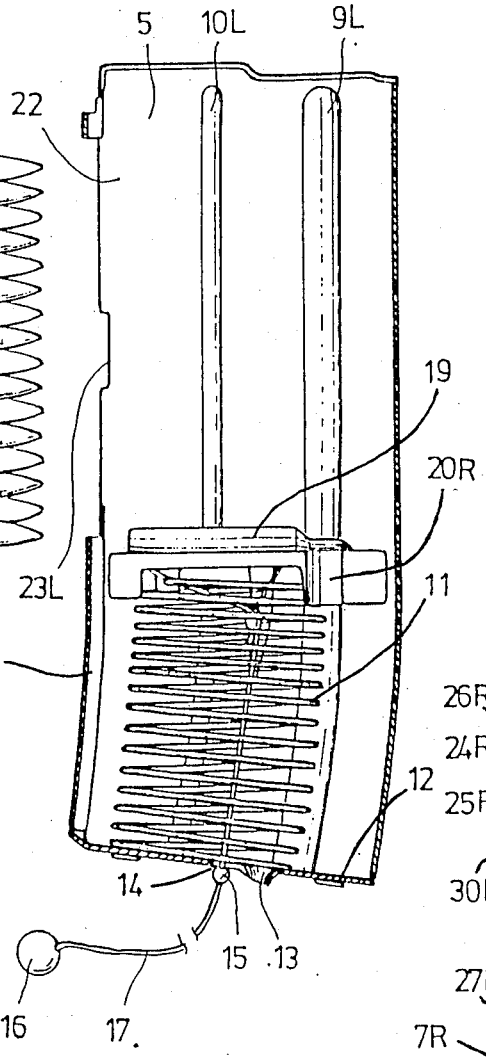
FIG. 8B is a sectional view of a magazine of the present invention.

Therefore, the present invention as described above and illustrated in FIGS. 8 to 10 and FIG. 1, in the case of loading ammunition 7 which is held securely in a cartridge clip 2 in a magazine 1 involves the steps of inserting the cartridge clip 2 into the magazine 1 which is fixed in inlet 4 of a weapon 3, as illustrated in FIG. 8, by pulling down and pulling cord wire 17 which is drawn out of the bottom 12 of a magazine 1 to depress and position the cartridge follower 8 below the inserting inlet opening 22 which is formed on the rear wall of a magazine 1. If the latcning ball 15 of the pulling cord wire 17 is locked in the small diameter latching hole (slot) 14 which communicates with the guide hold 13 the cartridge follower 8 is temporarily fixed at a position beneath the inserting inlet opening 22. When the cartridge clip 2 containing twenty to thirty rounds of ammunition is inserted into the inserting inlet opening 22, the fixing caps 28, 29 which cover the upper and lower parts of the cartridge clip 2 are released away from the cartridge clip 2 by the edges of the cartridge inlet opening 22 of the magazine and thus the cartridge clip is inserted without fixing caps 28, 29.

Figure 9:
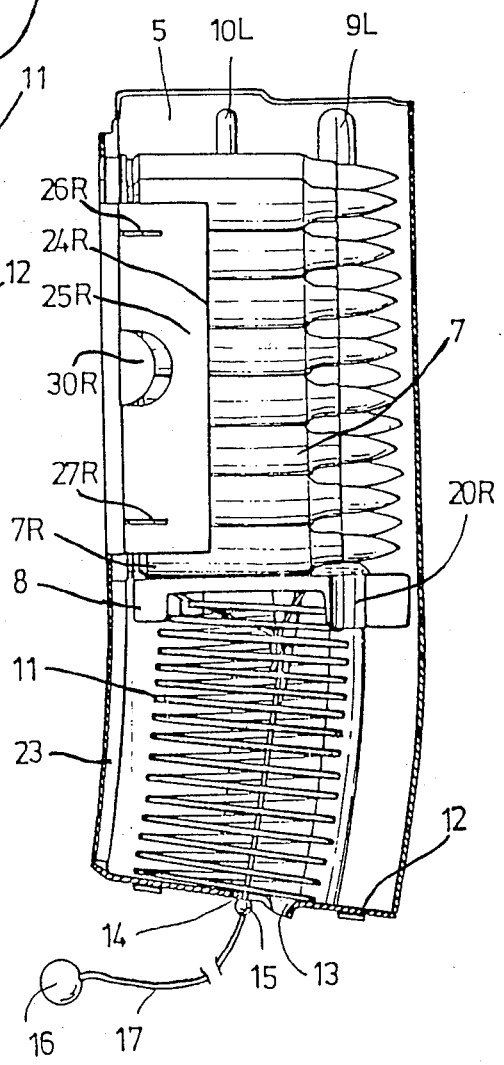
FIG. 9 is a sectional view of a magazine including a cartridge clip.

As illustrated in FIG. 9, when the cartridge clip is pushed into the magazine 1, the fixing caps 28, 29 are completely removed from the cartridge. At the same time the inserting finger grip pieces 30R, 30L which are formed on the rear of the side wall plate 25R 25L of the cartridge clip are inserted into the finger concave portions 23R, 23L which are formed on both sides of the inserting inlet opening 22 of a magazine 1 so that the cartridge clip 2 is held securely in a magazine. Therefore even if oscillation is caused by the reciprocating action of the breechblock, in the case of accidental firing, the release of the cartridge clip from the magazine or the scattering of the cartridges 7 are prevented.

Thus after a cartridge clip 2 is inserted into a magazine 1 through the inserting inlet opening 22, if the latching ball 15 of the pull cord wire 17 is released by pulling the pulling cord wire 17 from the latching hole 14 which is formed on the bottom 12 of a magazine 1, the cartridge follower 8, due to the elasticity of follower spring 11, engages the bottom of the cartridges 7.

Figure 10:
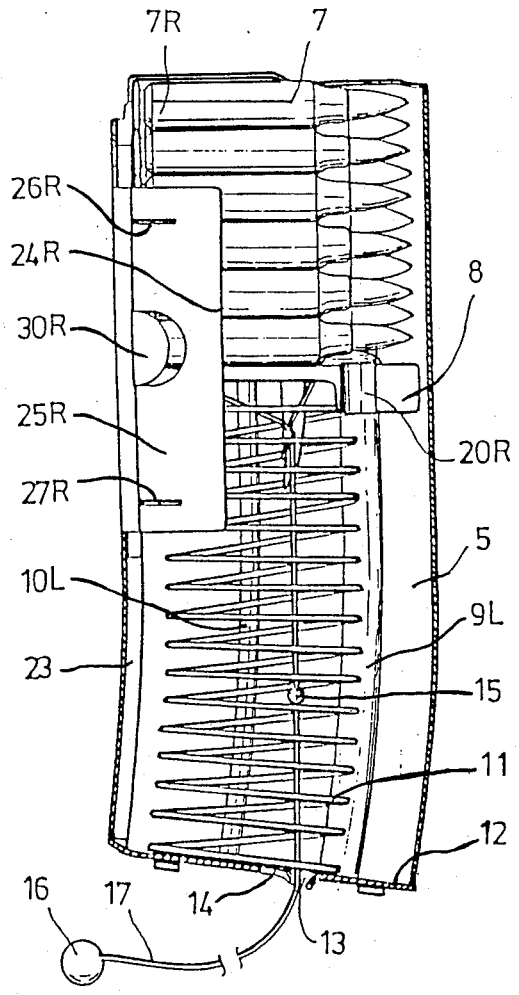
FIG. 10 is a sectional view of a cartridge clip and a magazine after some of the cartridges have been fired.

Then, as illustrated in FIG. 10, as the firings are executed and some of the spent cartridges are discharged, the cartridge follower 8 presses up against the cartridges due to the elasticity of the follower spring 12 and are charged successively into the weapon 3. Thus after the cartridges 7 of the cartridge clip 2 are all fired, the pulling cord wire 17 is again pulled down to the bottom of the magazine 1 and, as described above, after the cartridge follower 8 is depressed and fixed beneath the inserting inlet hole 22 of the magazine, the inserting finger grip pieces 30R, 30L are gripped and pulled out, and the empty cartridge clip is easily released and removed from a magazine 1. Accordingly a new cartridge clip 2 with cartridges 7 can be preloaded and inserted into the magazine similarly as described above.

Figure 12:
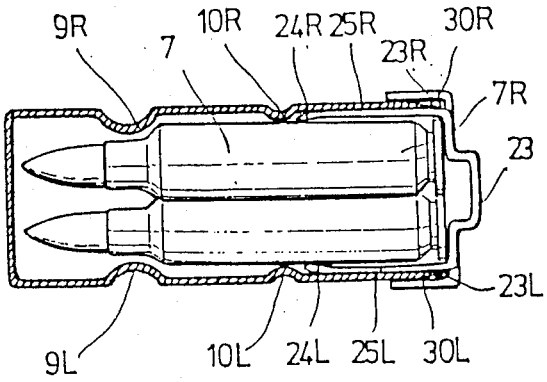
FIG. 12 is a cross-sectional view, taken along lines II—II of FIG. 11.
Figure 4:
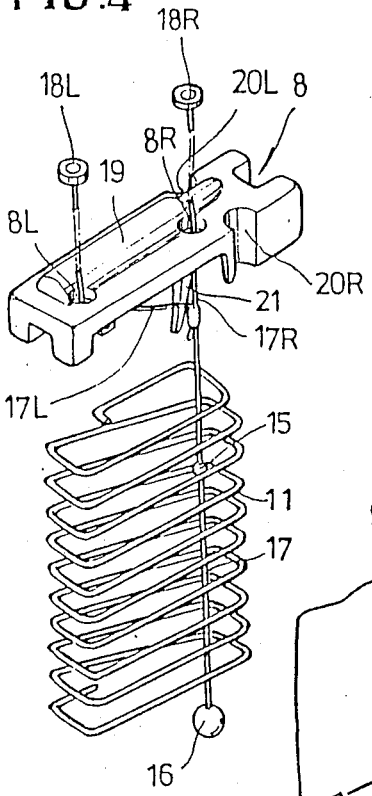
FIG. 4 is a perspective view of a cartridge follower of the present invention.
Figure 5:
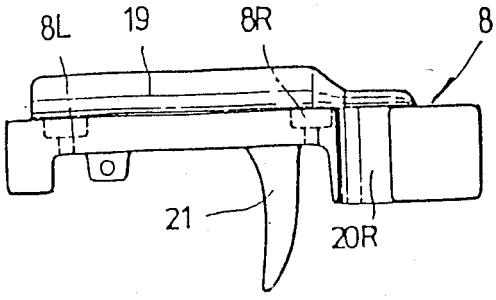
FIG. 5 is a side view of a cartridge follower of the present invention.
Figure 6:
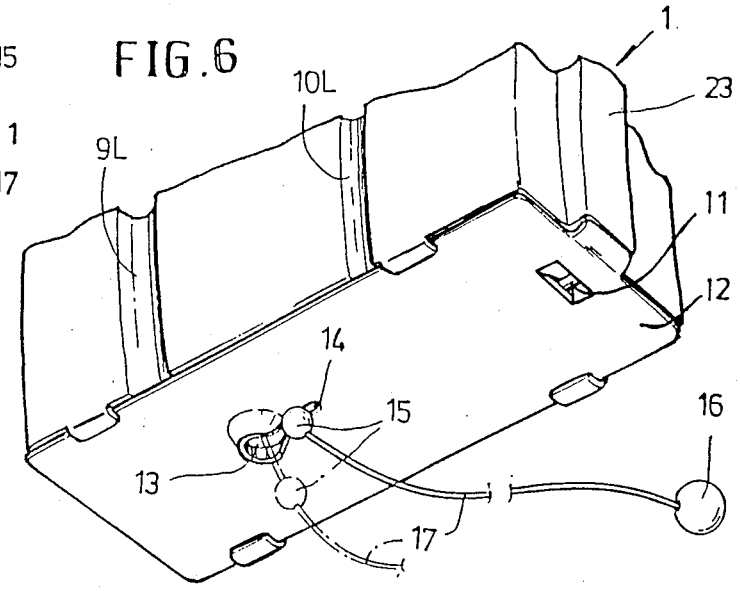
FIG. 6 is a perspective view of the bottom of a magazine according to the present invention.
Figure 7:
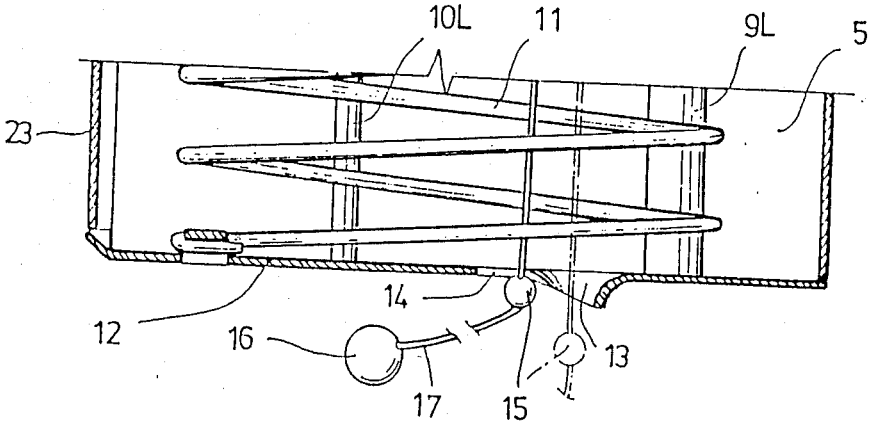
FIG. 7 is a detailed sectional view of the bottom portion of the present invention.

As illustrated in FIG. 12, the cartridge clip 2 edges 24R, 24L of the side wall plates 25R, 25L are formed to be inwardly and elastically inclined. Further because the cartridge fixing caps 28, 29 cover the upper and lower parts of the loaded cartridges 7 which are arranged in two zig-zag rows, the cartridges can be securely maintained so that in the case of moving, carrying or during the loading operation the cartridges 7 are prevented from scattering from the cartridge clip.

Thus according to the present invention, by utilizing a preloaded cartridge clip containing the cartridges, not only are the loading of the cartridges rapid and simple because the cartridges 7 can be loaded in a magazine by the simple action of inserting a cartridge clip into a magazine without removing the magazine 1 from the weapon, but also the firing power can be increased by loading the cartridges 7 into the magazine while observing the combat situation.

A comparison of the capacity of automatic small weapons having a magazine insert with the conventional clip type device is show in the following Table.

TABLE

A comparison of the number of cartridges fired in a conventional clip type weapon with the magazine type and an inserting clip type according to the present invention

| | | Classification | | | | | |
|---|---|---|---|---|---|---|---|
| | Designation of weapon | Time for pulling the cartridges or clip out of the cartridge belt | Time for inserting the cartridges into a magazine | Time for loading a magazine or a clip into a weapon | Time for firing twenty rounds of the cartridge | Number of cartridges fired in one minute. (During combat) (maximum capacity) day time | night time |
| conventional system | M-1 (semi-automatic a clip (8 rounds) | clip 2–4 sec. | none | clip 3 sec. (breech-block action time is included) | semi-automatic single shot 30 sec. | 40–50 rds. | 30–40 rds. |
| | M-16 (automatic weapon) conventional magazine is applied | 5–10 sec. | 17–18 rds. 20–30 sec. | magazine 2–3 sec. (breech-block action time is included) | automatic successive fire 5 sec. | spare magazine is used 100–110 rds. empty magazine is reloaded and reused 40–50 rds. | spare magazine is used 80–100 rds. empty magazine is reloaded and reused 30–40 rds. |
| invention | M-16 (automatic weapon) magazine of the invention is applied | 2–4 sec. | none | clip of the invention (20–30 rds.) 2–3 sec. (breechblock action time | automatic successive fire 5 sec. | 130–140 rds. | 110–120 rds. |

TABLE-continued

| A comparison of the number of cartridges fired in a conventional clip type weapon with the magazine type and an inserting clip type according to the present invention | | | | | | |
|---|---|---|---|---|---|---|
| | Classification | | | | | |
| Designation of weapon | Time for pulling the cartridges or clip out of the cartridge belt | Time for inserting the cartridges into a magazine | Time for loading a magazine or a clip into a weapon | Time for firing twenty rounds of the cartridge | Number of cartridges fired in one minute. (During combat) (maximum capacity) day time | night time |
| | | | is included | | | |

based on the required firing time
M-1, number of fire for a minute 500 rounds.
M-16, number of fire for a minute 700 rounds.

What is claimed is:

1. An ammunition containing device for loading into an automatic firing weapon which comprises, in combination, a magazine adapted to receive a cartridge clip which contains a plurality of rounds of ammunition, said magazine comprising:

a housing containing an inlet aperture, the walls of the magazine adjacent said inlet aperture having concave receiving means;

a spring means disposed in the bottom of the magazine;

a cartridge follower slidably disposed within the magazine adjacent said spring means;

means for depressing the cartridge follower within the magazine against the bias of the spring; and a cartridge clip containing ammunition adapted to be inserted through said inlet aperture into the magazine, above the depressed cartridge follower, the walls of said cartridge clip having projecting arms which extend into said concave receiving means.

2. The ammunition containing device of claim 1, wherein the cartridge clip contains releasing caps disposed at the top and a the bottom of the cartridge clip, said releasing caps being displaced as the cartridge clip is injected into the magazine.

3. The ammunition containing device of claim 1, wherein the means for depressing the cartridge follower comprises a cord which is attached to the cartridge follower and extends through the bottom of the magazine, said cord being provided with locking means for locking the cord when the cartridge follower is depressed against the bias of the spring.

4. The ammunition containing device of claim 3, wherein the locking means is a slot disposed in the bottom of the magazine and an enlarged element disposed on said cord and adapted to pass through one portion of said slot but engage another portion thereof.

5. The ammunition containing device of claim 4, wherein the end of the cord contains a stop member which is larger than any portion of said slot.

6. The ammunition containing device of claim 1, wherein the cartridge clip is preloaded with staggered rows of ammunition.

* * * * *